United States Patent [19]

Nishida

[11] Patent Number: 4,679,522

[45] Date of Patent: Jul. 14, 1987

[54] FLOAT DEVICE FOR SMALL SIZE BOAT

[75] Inventor: Hiroshi Nishida, Miki, Japan

[73] Assignee: Kawasaki Jukogyo Kabushiki Kaisha, Kobe, Japan

[21] Appl. No.: 878,505

[22] Filed: Jun. 23, 1986

Related U.S. Application Data

[63] Continuation of Ser. No. 686,678, Dec. 27, 1984, abandoned.

[30] Foreign Application Priority Data

Dec. 28, 1983 [JP] Japan ..... 58-202323

[51] Int. Cl.[4] ..... B63B 35/00

[52] U.S. Cl. ..... 114/357; 441/127; 441/129

[58] Field of Search ..... 441/35, 65, 74, 125–130; 114/264–267, 343, 357

[56] References Cited

U.S. PATENT DOCUMENTS

| | | | |
|---|---|---|---|
| 4,041,561 | 8/1977 | Humphrey | 114/357 |
| 4,276,844 | 7/1981 | Fremont | 114/357 |
| 4,365,580 | 12/1982 | Blount | 114/357 |

FOREIGN PATENT DOCUMENTS

| | | | |
|---|---|---|---|
| 3879 | 2/1978 | Japan | 114/357 |

*Primary Examiner*—Jeffrey V. Nase
*Assistant Examiner*—C. T. Bartz
*Attorney, Agent, or Firm*—Leydig, Voit & Mayer

[57] ABSTRACT

A float inserted in a small size boat is formed of a central portion made of hard foamed plastic and an outer layer portion made of soft foamed plastic.

2 Claims, 2 Drawing Figures

FLOAT DEVICE FOR SMALL SIZE BOAT

This application is a continuation of application Ser. No. 686,678, filed Dec. 27, 1984, now abandoned.

BACKGROUND OF THE INVENTION

1. FIELD OF THE INVENTION

The present invention relates to an improvement in a float device for a small size boat provided in its body with a float made of foamed plastic in order to keep a necessary buoyancy in case of submergence.

2. DESCRIPTION OF THE PRIOR ART

For example, in a small size boat to be manipulated from a standing or sitting posture, a float made of foamed plastic is provided at a rear side of a body constituted by deck and hull, so that necessary buoyancy may be kept even if the deck or the hull is damaged (refer to Japanese Patent Publication No. 3879/78).

The float is made solely of either hard foamed plastic of high density or soft formed plastic of low density.

In the case where a driver's weight load is applied onto a floor of the deck, if the float is made of hard material, a local high stress is likely to be applied to the floor. It is therefore necessary to further increase the mechanical strength of the materials of the floor and the float.

On the other hand, if the float is made of soft material, a force applied to the float is widely dispersed but the deformation per se will become large. This is not convenient for reducing a stress applied to the deck.

Such a float has sometimes been formed by foaming the material in the working site. However, without foaming the material in the working site, a foamed body formed, in advance, in a mold has frequently been inserted into a boat body. In this case, if the foamed material is soft, it may be made to fit the boat body. However, if the foamed material is hard it is difficult to make the foamed body fit with the boat body in assembly. In the latter case, a dimensional error would cause an undesired clearance or gap to be generated between the boat body and the foamed body.

SUMMARY OF THE INVENTION

In order to overcome the above-noted shortcomings inherent in the prior art, it is an object of the present invention is to form an outer layer, made of soft foamed plastic, around a float, so that when the float is inserted into a boat body, the float may be fitted in the boat body without any clearance or gap to thereby prevent an excessively local stress from being generated in the floor and float, and to form a central core, made of hard foamed plastic, in the float, so that an excessive deformation of the floor may be suppressed and a bending stress existing in the deck may be decreased.

To attain the above-described object, according to the present invention, there is provided a float composed of a central portion made of hard foamed resin of high density and an outer layer portion made of soft foamed resin of low density.

DETAILED DESCRIPTION OF THE PREFERRED EMBODIMENTS

Figure 1:
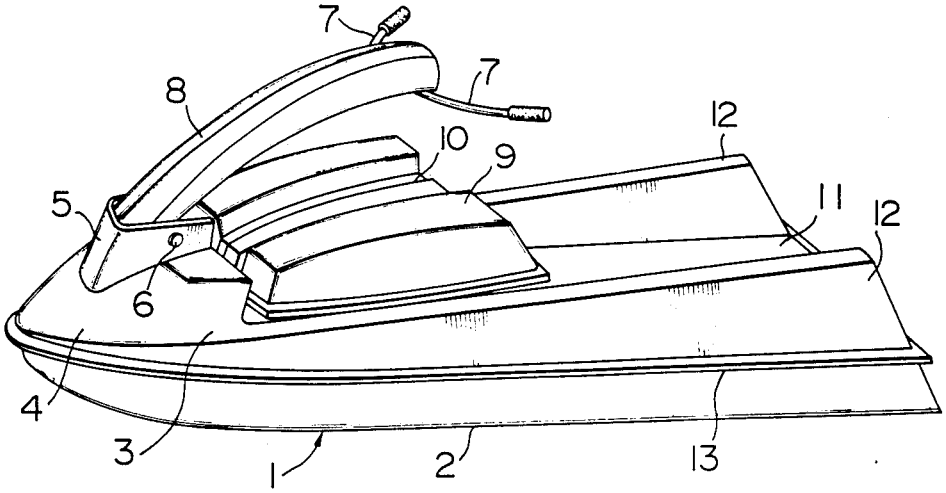
FIG.1 is a perspective view showing a small size boat in accordance with one embodiment of the invention.

One embodiment of the present invention will now be described with reference to the accompanying drawings. In FIG. 1, a boat body 1 made of FRP (fiber-reinforced plastic) is comprised of a lower hull 2 and a deck 3. A handle pole bracket 5 extends from a front boat portion 4. A handle pole 8 having handle levers 7 is rotatably supported on a pivot shaft 6 provided in the bracket 5. An engine cover 9 is arranged behind the handle pole bracket 5. A concave portion 10 is formed on an upper side of the engine cover 9.

Figure 2:
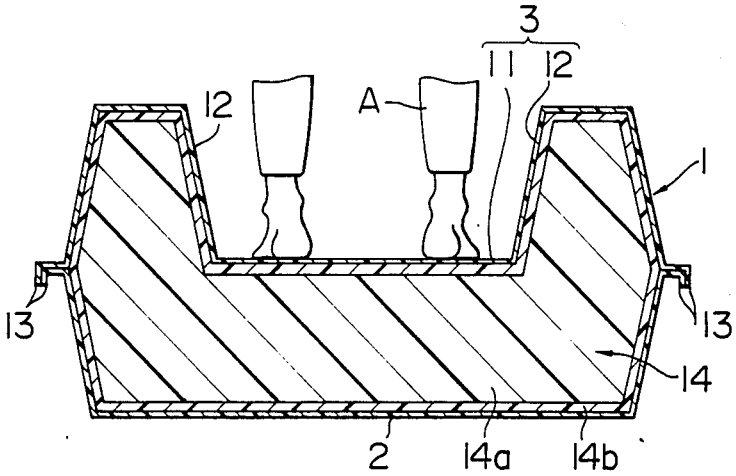
FIG. 2 is a transverse cross-sectional view of a rear portion of the boat shown in FIG. 1.

As shown in cross section in FIG. 2, a rear portion of the deck 3 is formed of a floor 11 located in a central portion and a pair of fins or walls 12 projecting upwardly from opposite side edges of the floor 11. The lower hull 2 is fixedly coupled to the deck 3 by adhesives along peripheral flanges 13.

A float 14 is inserted into a space defined by the deck 3 and the hull 2. In this case, the float 14 has its central portion a hard foamed plastic **14*a* of high density and at its outer layer portion a soft foamed plastic 14*b*** of low density.

The above-described central portion **14*a* is formed in a shape substantially geometrically similar to the internal cavity defined by the deck 3 and the hull 2, but somewhat smaller in size than the cavity. The outer layer portion 14*b* having a suitable thickness is formed to surround the outer periphery of the central portion 14*a***. Although the float in the embodiment shown is of the built-in type, the float may be formed by foaming the material in the site.

With such a construction, if the central portion **14*a* and the outer layer 14*b* together, have a shape substantially geometrically similar to, but somewhat larger than the cavity within the boat body 1 when the outer layer is not compressed, there is no fear that a clearance or gap would be generated between the float 14 and the boat body 1 upon the insertion of the float 14 into the cavity within the boat body 1 when the float is confined within and the soft outer layer is compressed within the cavity. Also, since the outer layer portion 14*b* is made of soft material, there is no difficulty in assembling the boat body 1** with adhesives or the like.

Also, when the driver A rides on the floor 11, since his weight load is applied to the outer layer portion **14*b*, any concentration of local force will not be generated in the floor 11. Therefore, a stress produced in the floor 11 will be small. Also, since the outer layer portion 14*b*** made of soft material has a cushion effect, a desired drivability or ridabilty may be enjoyed.

Also, since the float 14 as a whole is not made of soft material, but the outer layer portion **14*b* is made solely of soft material while the central portion 14*a* is made of hard material, a deformation of the above-described floor 11 may be suppressed within a desired limit. Therefore, a bending stress existing in deck 3** is decreased.

As is apparent from the foregoing description, according to the present invention, the float having a inherent function of keeping a buoyancy has a function of enhancing a mechanical strength and a rigidity of the boat. In a recent small size boat, a hard urethane is used as a foamed body and is to be foamed in the site. Therefore, it is required to wait for hardening of the foamed material in a jig or mold. Therefore, the prior art suffers from such a defect that the productability is not improved. However, in accordance with the present invention, since the central unit of the foamed body molded separately from the outer layer portion may be inserted into the outer layer portion of soft foamed plastic of low density used as a cushion material, the productability is enhanced.

Further, in foaming the float in the site solely with a single kind of resin, some material such as a bead foamed material of P. E. cannot be used. However, according to the present invention, such material can be used. As a result, the foamed body may be light in weight and low in cost.

I claim:

1. A small size boat comprising a boat body made of hard material having an inside surface defining a cavity and a float which has been inserted in said cavity, said float having a central portion of buoyant hard foamed plastic of high density which comprises a larger portion of said float and has a shape substantially geometrically similar to, but smaller than, the cavity, and an outer portion of buoyant soft foamed plastic of low density which forms an outer layer around said central portion and comprises a smaller portion of said float, said outer layer being formed such that said central portion and said outer layer, together, have a shape substantially geometrically similar to, but larger than, the cavity when said outer layer is not compressed so that, when said float is confined within the cavity, said soft outer layer is compressed within the cavity and conforms with the inside surface of the body of the boat.

2. A small size boat according to claim 1 wherein said boat body includes hull and deck portions defining said cavity, said hull portions having sections projecting upwardly and said deck portion being flat and extending between said upwardly projecting hull portions, and said soft outer layer and said hard central portion having sections below and supporting said deck portion, the hard central portion deck-supporting section having greater thickness than the soft outer layer deck-supporting section, and the soft outer layer deck-supporting section providing a cushion effect.

* * * * *